US005234170A

United States Patent [19]

Schirmer et al.

[11] Patent Number: 5,234,170

[45] Date of Patent: Aug. 10, 1993

[54] FUEL INJECTION VALVE

[75] Inventors: Günter Schirmer, Ingersheim; Walter Lehr, Stuttgart, both of Fed. Rep. of Germany; Arnold Kelly, Princeton Jct., N.J.

[73] Assignee: Robert Bosch GmbH, Stuttgart, Fed. Rep. of Germany

[21] Appl. No.: 820,636

[22] PCT Filed: Mar. 27, 1991

[86] PCT No.: PCT/DE91/00270

§ 371 Date: Jan. 24, 1992

§ 102(e) Date: Jan. 24, 1992

[87] PCT Pub. No.: WO91/15673

PCT Pub. Date: Oct. 17, 1991

[30] Foreign Application Priority Data

Apr. 7, 1990 [DE] Fed. Rep. of Germany ..... 4011372
Sep. 13, 1990 [DE] Fed. Rep. of Germany ..... 4029056

[51] Int. Cl.[5] ..... F02M 27/04; B05B 5/025

[52] U.S. Cl. ..... 239/690; 239/708; 239/533.12; 239/585.1; 123/538

[58] Field of Search ..... 239/690, 708, 697, 698, 239/585.1, 585.3-585.5, 533.12; 123/538

[56] References Cited

U.S. PATENT DOCUMENTS 4,051,826 10/1977 Richards ..... 123/143 B
4,077,374 3/1978 Willmann et al. ..... 239/533.12
4,150,644 4/1979 Masaki et al. ..... 239/696
4,364,342 12/1982 Asik ..... 123/143 B
4,581,675 4/1986 Kelly ..... 239/704

FOREIGN PATENT DOCUMENTS 0193757 11/1982 Japan ..... 123/538
2058908 4/1981 United Kingdom ..... 239/690

*Primary Examiner*—Andres Kashnikow
*Assistant Examiner*—Karen B. Merritt
*Attorney, Agent, or Firm*—Edwin E. Greigg; Ronald E. Greigg

[57] ABSTRACT

A fuel injection valve for fuel injection systems of internal combustion engines has a hollow nozzle body with a fuel valve chamber and with a nozzle opening for the emergence of the fuel. A valve seat, which interacts with a valve member, is formed in the interior of the nozzle body. To achieve high-grade atomization or charging of the fuel emerging from the nozzle opening, two electrodes connected to a high voltage are provided, of which at least one is composed of a material suitable for field emission of electrical charge carriers. One electrode is arranged on a valve member and the other electrode on the nozzle body, in such a way that an electric field which passes through the flow of fuel is formed directly upstream or downstream of the valve seat.

27 Claims, 8 Drawing Sheets

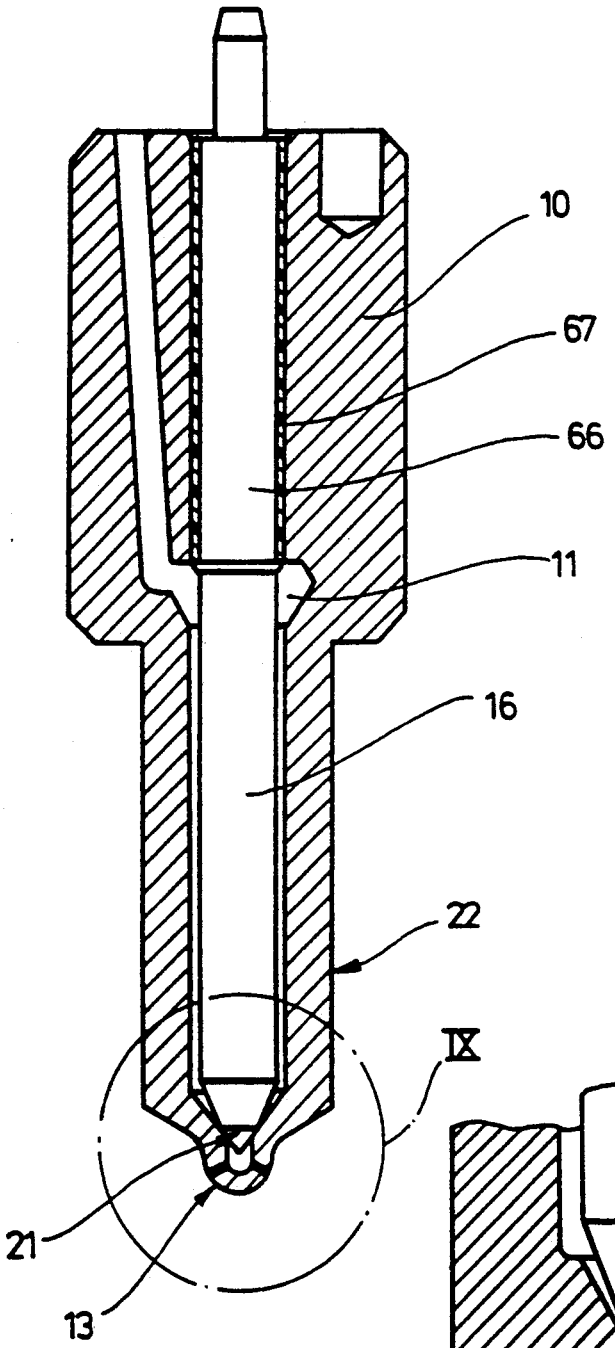
Fig. 8
Fig. 9
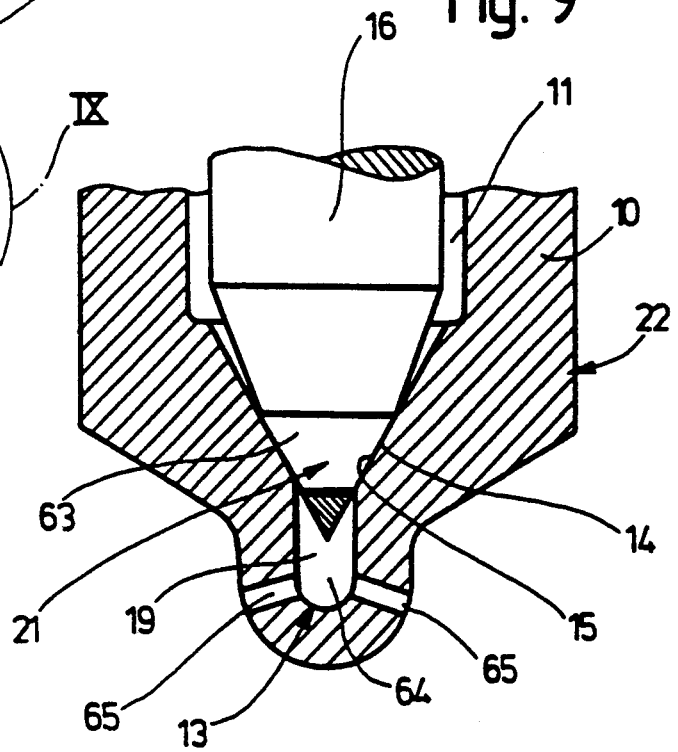

FUEL INJECTION VALVE

PRIOR ART

The invention relates to a fuel injection valve for fuel injection systems of internal-combustion engines, of the type defined hereinafter.

Such fuel injection valves, also referred to as fuel injection nozzles, are disclosed, for example, in DE 35 40 660 Al or DE 37 05 848 Al. U.S. application Ser. No. 07/134,718, filed Dec. 18, 1987. The actuation of the valve member is effected by an actuator, which generally comprises an electromagnet and a closing spring which act on the valve member with mutually opposite forces. By means of the duration of the excitation of the electromagnet it is possible to meter with great precision the quantity of fuel injected by means of the fuel injection valve into an intake pipe or directly into the combustion chamber of the internal-combustion engine. For a high utilisation of the fuel, optimum combustion is a precondition and for this, in turn, very good fuel atomization during injection is required. An attempt is made to achieve this by suitable design of the nozzle opening and high injection pressure.

DE 28 50 116 Al discloses an electrostatic atomisation device for the electrostatic atomisation of flowing media, which has a housing through which the medium flows and in which two electrodes are arranged at a distance from one another, the said electrodes being connected to a high voltage of, for example, 100 V to 30 kV. At least one electrode is produced from a material suitable for field emission of electrical charge carriers. Such a material has a large number of fine peaks and/or edges, with the result that, on the one hand, the strong electric fields necessary for field emission are produced at the electrode surface and, on the other hand, a sufficiently large current flows to achieve sufficient charging of the liquid even at high flow rates. One example of a suitable material which may be mentioned is a eutectic mixture of uranium oxide and tungsten, the tungsten here being incorporated in the form of fine fibres into the uranium oxide. The second electrode is preferably produced from platinum, nickel or stainless steel. Emitted charges are picked up by the medium guided through the electric field in the intermediate-electrode space and the medium is thereby electrically charged. This charging has the effect that the medium atomizes after leaving the device. Areas of application given for the electrostatic atomization device are: burners for oil-fired heating systems, spraying equipment for insecticides in agriculture, spraying equipment for applying paints, oils, plastics to objects, injection equipment for fuel in combustion engines.

ADVANTAGES OF THE INVENTION

The fuel injection valve according to the invention, has the advantage that electrostatic charging and the metering of the fuel can be carried out in the fuel injection valve itself. Due to the unipolar electrical charging of the fuel, the latter atomizes owing to the forces acting between the charges. This electrostatic atomization can improve the quality of atomization of the injection valve by bringing about a smaller droplet size and a narrow droplet size distribution. The electrostatic atomization is independent of the structurally determined metering and atomozing function of the fuel injection valve. The energy expenditure required for the electrostatic atomization is low and is typically around 50 to 100 mW. Due to the electrical charging of the droplets, the fuel spray mist opens out automatically after leaving the nozzle opening The spray mist can be influenced by electric and/or magnetic fields, allowing the spray mist to be guided or varied in its shape. Because of the mutual repulsion of the droplets charged with the same sign, droplet coagulation is reduced. The charge on the burning droplets or fuel molecules has a positive influence on the course of combustion. In addition, a reduction in the development of soot can be expected since the charged primary particles of soot coagulate less easily and thus burn better.

The high voltage used for the electrodes is preferably a direct voltage, the negative potential preferably being connected to the emitter electrode. The use of alternating voltage is possible, in which case both electrodes can emit charge carriers. The high voltage applied can be varied in polarity and amount with time, it being possible to perform the variation slowly or rapidly in comparison with the duration of the injection cycle or to be synchronised with the injection cycle. In principle, tips, edges, balls, plates, rings, tori, coaxial annular electrodes or other geometrical shapes are suitable as electrode shapes.

Advantageous further developments and improvements of the fuel injection valve specified are possible by virtue of the measures presented hereinafter.

By the provision of a third electrode downstream of the nozzle opening as seen in the direction of flow of the fuel, the said electrode being connected to voltage, it is possible to shape an electric field in the outer space and thus influence the fuel spray mist.

In a preferred embodiment of the invention, in which the valve member is designed as a valve needle which is guided in axial fashion in the valve chamber and, at the end, bears an annular closing face which interacts with the valve seat positioned upstream of the nozzle opening, the emitter electrode is arranged on that front end of the valve needle which faces the nozzle opening. In this arrangement, it is possible, on the one hand, for the emitter electrode to be inserted coaxially and in insulated fashion into the valve needle in such a way that it protrudes with a cone from the latter at the front end. The high-voltage supply to the emitter electrode is effected centrally through the valve needle, the electrical supply lead being insulated from the valve needle. The counterelectrode is formed by the nozzle body, which is connected to a voltage potential which is positive relative to the emitter electrode, preferably to earth. On the other hand, the emitter electrode can also be formed by a ring of suitable material which is secured on the front end of the valve needle and the annular wall of which tapers towards the free end and ends in an annular ridge. In this case, the counterelectrode is formed by an annular face which surrounds the nozzle opening and is connected to a positive high-voltage potential while the valve needle is connected to a voltage potential which is negative relative to the counterelectrode, preferably to earth. This embodiment variant has the advantage that the high-voltage lead through the nozzle body is simpler to realise than a high-voltage lead which is to be inserted into the mobile and, typically, slender valve needle and provided with sufficient insulation.

In a further embodiment of the invention, the emitter electrode is integrated into the tip of the valve needle, the said tip being of insulated design, and protrudes with an annular face from the said valve needle. The emitter electrode is connected to a high-voltage potential. The nozzle body, but, in particular, a perforated plate inserted into the nozzle opening, is here used as a counterelectrode. This has the advantage that, with a predetermined cross-sectional area of the nozzle, the diameter of the individual fuel jets emerging can be varied by means of the nozzle openings. It is thereby possible to control the electrical field strength at the outside of the emerging fuel jets, this being advantageous since, in the case of excessively high field strengths, corona discharges occur at the surface of the fuel, lowering the charge of the fuel and reducing the quality of atomization.

The electrical high-voltage supply leading to the emitter electrode is advantageously divided into two supply lead portions, of which one is connected to the emitter electrode and ends in the outer surface of a sliding portion of the valve needle, on which the valve needle is guided in displaceable fashion on the inner wall of the nozzle body. The other supply lead portion is connected to the negative high-voltage potential and ends in the inner wall of the nozzle body. The two end points of the two lead portions are placed in such a way relative to one another that, with the valve needle lifted off from the valve seat, they contact each other and, with the valve needle resting on the valve seat, they are separated from each other. By virtue of this manner of feeding in the high voltage, the emitter electrode is only connected to voltage and emits charges when the valve needle has been lifted off, i.e. only during the injection process.

In a further embodiment of the invention, the valve needle is of frustoconical design at the front end and, on the end face of its truncated cone, bears an insulating cylinder which projects through the nozzle opening. The emitter electrode is designed as an annular face on the insulating cylinder and is connected via an electrical supply lead passed through the valve needle in insulated fashion to a negative high-voltage potential. The counterelectrode is formed by the nozzle body, which is connected to a voltage potential which is positive relative to the emitter electrode, preferably to earth. In this construction, it is advantageous that the electrode spacing does not vary during the movement of the valve needle and that a compensating adaptation of the voltage applied does not have to be performed. The annular discharge face of the emitter electrode permits controllability of the surface field strength of the emerging fuel. The discharge face or surface of the annular emitter electrode can advantageously be designed as a pointed annular edge.

In a further embodiment of the invention, the emitter electrode is formed by a nozzle-body region which contains the nozzle opening, which is composed of a material suitable for field emission of electrical charge carriers and is electrically insulated from the remainder of the nozzle body. This region is connected to the negative high-voltage potential, while the valve needle, which, at its front end facing the nozzle opening, bears a conical tip, forms the counterelectrode and is connected to earth potential. Such a realisation of the electrostatic injection valve has the advantage that all the components required for the electrical charging are fitted into the injection valve in a constructionally simple way.

In a further embodiment of the invention, the emitter electrode is arranged in insulated fashion as an annular face in the valve chamber, directly upstream of the valve seat and is connected to high-voltage potential. The nozzle body and, above all, the valve needle serve as the counterelectrode. By virtue of this structural configuration, the charging zone of the fuel is upstream of the valve seat. This is favourable since, as a result, the electrodes are not exposed to the external atmosphere and are thus not contaminated. In this arrangement, a spark discharge can therefore not occur between the electrodes because no gas atmosphere can enter the region of the intermediate electrode. To form a multi-spray injection valve, the nozzle opening can, in addition, be closed off by a non-metallic body, preferably a ceramic body, which has a blind hole coaxial to the nozzle opening and at least one fuel outlet bore which extends at an angle to the axis of the nozzle body and opens into the blind hole. Such a ceramic body prevents the electrical charges injected into the fuel from flowing off via the nozzle body before emergence from the fuel injection valve.

In the case of an outward-opening fuel injection valve in which the valve member is formed by a truncated cone which is secured on an actuating rod projecting through the opening surrounded by the valve seat, and in which the valve seat is formed on the valve body on that side of the opening which faces away from the valve chamber, the emitter electrode is again formed by an annular face which is arranged in insulated fashion on the nozzle body, directly upstream of the valve seat. The emitter electrode is preferably formed by an annular disc which is inserted in electrically insulated fashion into the nozzle body, transversely to the axis of the nozzle body, in such a way that its inner annular edge, which preferably tapers to a point, protrudes slightly from the inner wall of the nozzle body or ends flush with the said inner wall. The electrical high voltage is fed in via the nozzle body. In addition to the arrangement of the electrodes upstream of the valve seat, the absence of a clearance volume is advantageous here. This is advantageous since the quantity of fuel situated in a clearance volume can sometimes leave the injection valve only in a poorly atomized or non-atomized state.

According to a further embodiment of the invention, a pin-shaped extension is secured on the free front face of the valve member, which front face faces away from the valve seat and/or a coaxial annular electrode can be mounted in insulated fashion on the end of the nozzle body. These electrodes in the outer space allow the production of electric fields for influencing the charged fuel after it leaves the fuel injection valve. It is possible, for example, by means of such an external electric field to prevent droplets being drawn out of the spray mist, back to the outside of the nozzle and having a negative influence on the atomization process. A possible extension pin can be secured in insulated fashion on the valve member and connected to a suitable electric potential, increasing the possibility of variation for the electric fields in the outer space.

DRAWING

The invention is explained in greater detail in the following description with reference to illustrative embodiments depicted in the drawing, in which:

FIGS. 2–8 are portion cross-sectional views of different modifications of the fuel injection valve shown in FIG. 1; and FIG. 9 is an enlarged partial cross-sectional view illustrating the details of the end portion IX of FIG. 8.

DESCRIPTION OF THE ILLUSTRATIVE EMBODIMENTS

Figure 1:
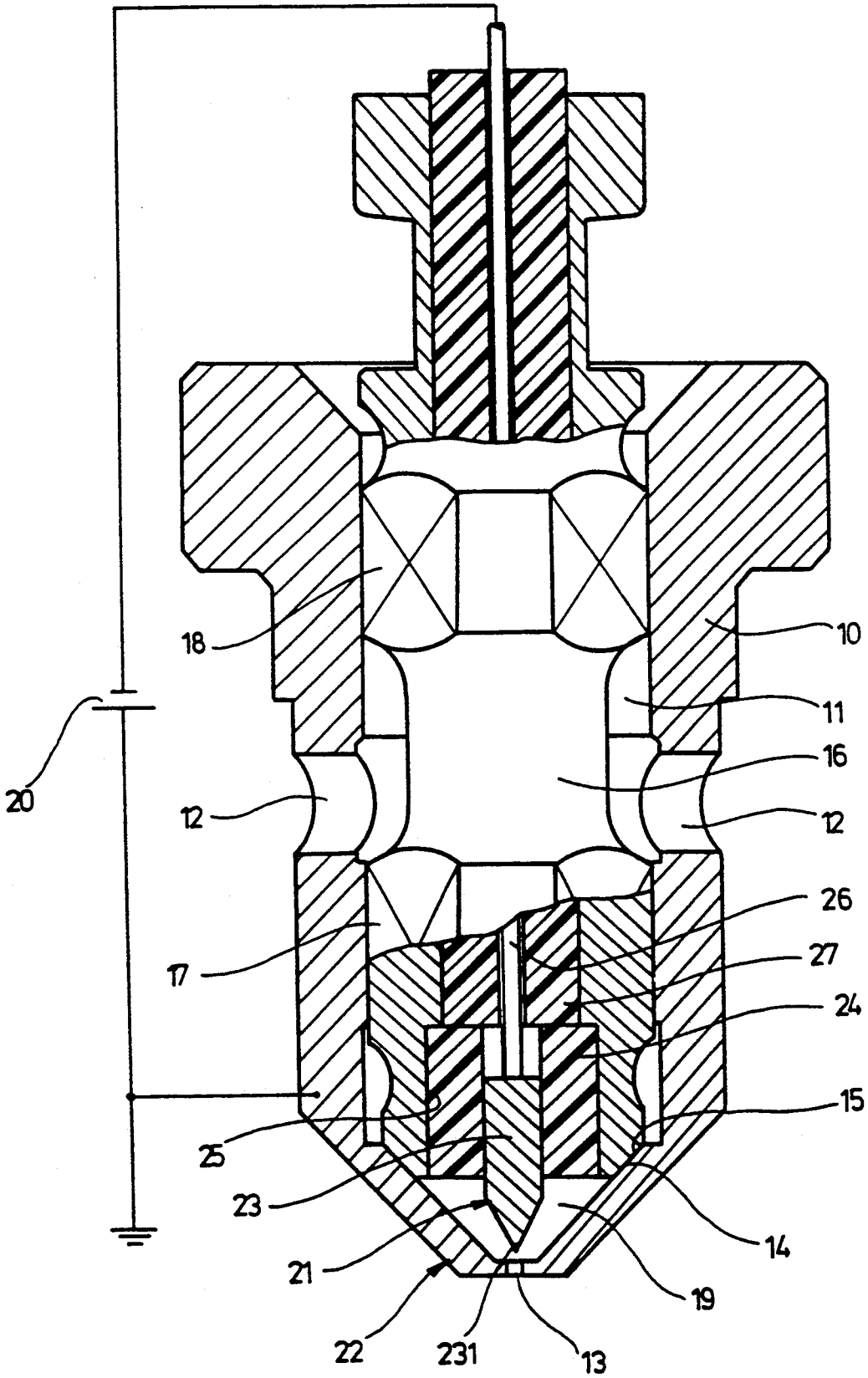
FIG. 1 is a partial longitudinal cross-sectional view of a fuel injection valve for a fuel system.

The fuel injection valve depicted partially in longitudinal section in FIG. 1 is essentially known and hence only that which is essential to the invention is depicted here. Such a fuel injection valve is depicted and described in DE 35 40 660, as a top-feed valve, and in DE 37 05 848 Al, as a side-feed valve. In general, it has a valve casing of ferromagnetic material (not shown here) which accommodates a hollow metallic nozzle body, denoted by 10 in FIG. 1, in its lower end. The nozzle body 10 surrounds a fuel-filled valve chamber 11, which is connected via radial bores 12 to a fuel-filled casing space which, for its part, is supplied with fuel via a connection piece of the valve casing. At its lower end, the nozzle body 10 is of frustoconical design and bears a coaxial nozzle opening 13 in its free front face. Formed on the inner wall of the frustoconical region, at a distance from the nozzle opening 13, is a valve seat 14 which interacts with a valve closing face 15 on a valve needle 16 for the purpose of opening and closing the injection valve, sometimes also referred to as injection nozzle. Together with the lower wall region of the nozzle body 10, the said wall region containing the nozzle opening 13, the valve seat 14 with the valve needle 16 resting on it delimits an intermediate space 19 through which the fuel flows when the valve is open in order then to emerge from the nozzle opening 13. The valve needle 16 is guided in axially displaceable fashion in the valve chamber 11, for which purpose it has two sliding portions 17, 18 of relatively large diameter which rest against the inner wall of the nozzle body 10. As indicated in FIG. 1, the sliding portions 17, 18 are flattened, allowing fuel flow from the radial bores 12 to the valve seat 14. The valve needle 16 is actuated by an electromagnet (not shown here) arranged in the upper part of the valve casing or, in the case of diesel injection pumps, by the pump pressure. The closing face 15 of the valve needle 16 is pressed onto the valve seat 14 by means of a closing spring (not shown here) and the valve is closed. For injection, the electromagnet, the armature of which is connected to the valve needle 16, is excited for a predetermined period. The armature is attracted and the valve needle 16 is lifted off from the valve seat 14 counter to the closing spring. The injection valve is opened for a predetermined injection period and fuel emerges via the nozzle opening 13.

To achieve a good atomization of the emerging fuel in the form of a spray mist, two electrodes 21, 22, which are connected to a high voltage supplied by a high-voltage source 20, are integrated into the fuel injection valve. At least one of the electrodes 21, 22, the so-called emitter electrode, is composed of a material which is suitable for field emission of electrical charge carriers, while the other electrode forms the counterelectrode. One example of such a material is a eutectic mixture of uranium oxide and tungsten, the tungsten being incorporated in the form of fine fibres into the uranium oxide. The material has a sufficiently large number of fine peaks or edges, with the result that sufficiently strong electric fields are produced at the surface of the material for field emission. The two electrodes 21, 22 are here arranged in such a way that an electric field passing through the fuel is formed directly upstream or downstream of the valve seat 14, as seen in the direction of flow of the fuel.

In the illustrative embodiment depicted in FIG. 1, the electric field is produced downstream of the valve seat 14, in the intermediate space 19. For this purpose, the emitter electrode 21 is arranged on the front end of the valve needle 16 which delimits the intermediate space 19 towards the nozzle opening 13. The emitter electrode 21 is designed as a peg 23 which bears a conical tip 231 at the front end. The peg 23 is inserted in insulated fashion into the valve needle 16 in such a way that it is essentially the conical tip 231 which protrudes and projects into the intermediate space 19. For this purpose, the peg 23 is inserted in an insulating cylinder 24 which is inserted coaxially into a recess 25 in the valve needle 16, the said recess having been introduced from the front end. At the flat end, the peg 23 is connected to an electrical connecting lead 26 which, surrounded by an insulating covering 27, is passed coaxially through the valve needle 16. The emitter electrode 21 is connected to the negative high-voltage potential of the high-voltage source 20, while the nozzle body 10 must have a more positive potential than this and, for this purpose, is connected to the earth potential of the high-voltage source 20. When the valve is open, the flow of fuel is guided through the electrostatic field formed in the intermediate space 19, charges being picked up by the fuel and the fuel leaving the intermediate space 19 with an electrically unipolar charge through the nozzle opening 13. Due to the charging achieved in this way, the fuel atomizes after emerging from the nozzle opening 13 as a result of the electrical repulsion forces acting between the charges.

In the illustrative embodiments of a fuel injection valve which are depicted in the further FIGS. 2–7 of the drawing, those components which correspond to those in FIG. 1 are provided with identical reference numerals. These fuel injection valves are also only described to the extent that there are differences with respect to the fuel injection valve described in FIG. 1.

Figure 2:
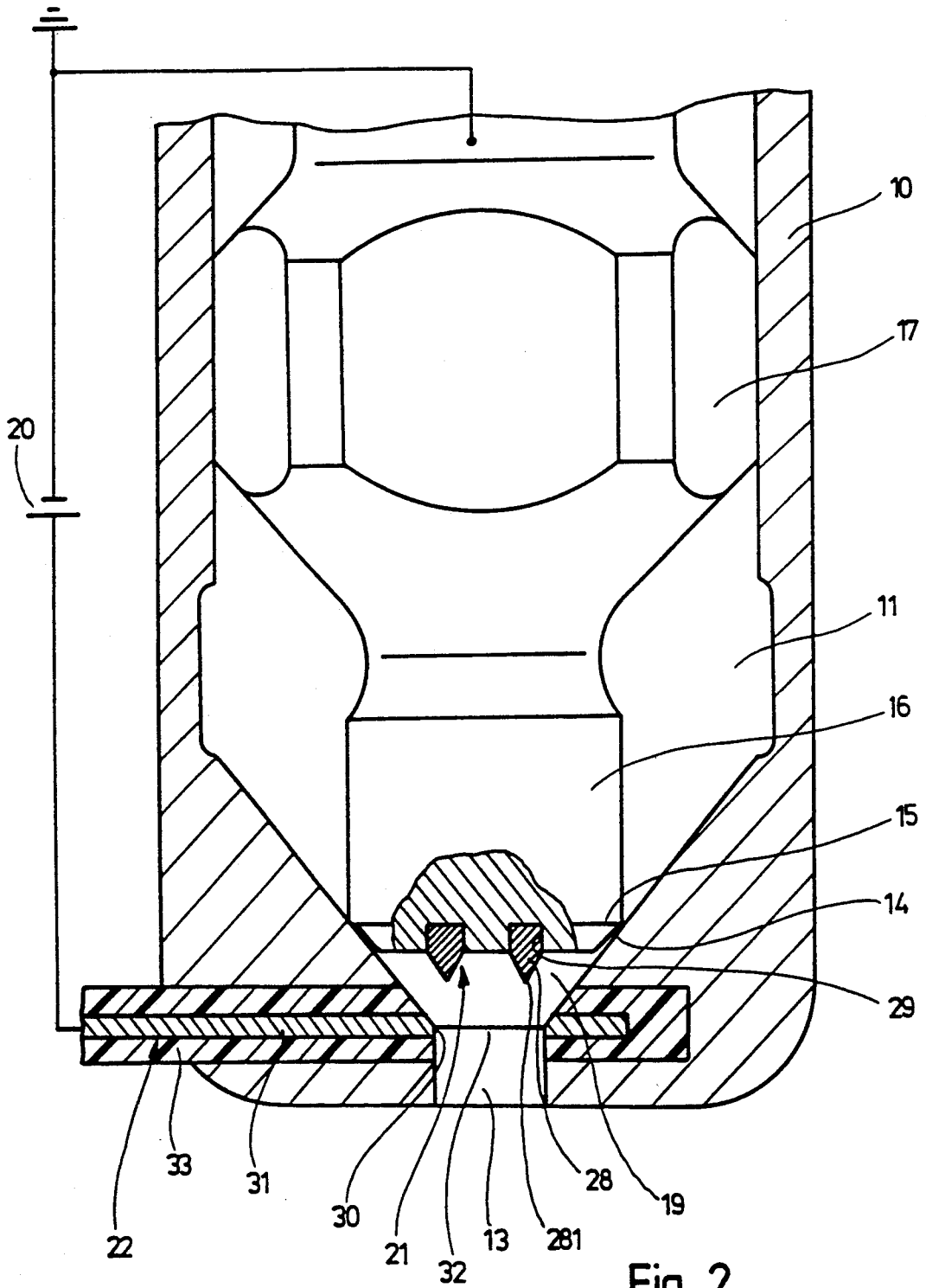

In the fuel injection valve depicted partially and in longitudinal section in FIG. 2, the emitter electrode 21 is formed by an annular cylinder 28 which is secured on the front end of the valve needle 16 and the annular wall of which tapers towards the free end and ends in an annular ridge 281. The annular cylinder 28 is adhesively bonded into an annular groove 29 on the front end of the valve needle 16. The counterelectrode 22 is formed by an annular face 30 which surrounds the nozzle opening 13 and is connected to the positive high-voltage potential of the high-voltage source 20 As regards construction, this annular face 30 is realized by an electrically conducting plate 31 which is pushed in transversely to the axis of the nozzle body in the region of the nozzle opening 13 and bears a passage opening 32 which is congruent with the nozzle opening 13. The wall of the bore in the plate 31 can be bevelled, the annular face 30 thus ending in an annular point. The plate 31 is connected to the positive high-voltage potential of the high-voltage source 20 and is electrically insulated from the nozzle body 10 by an insulating layer 33 completely surrounding the plate 31. The valve needle 16 bearing the emitter electrode 21 is connected to the earth potential of the high-voltage source 20.

Figure 3:
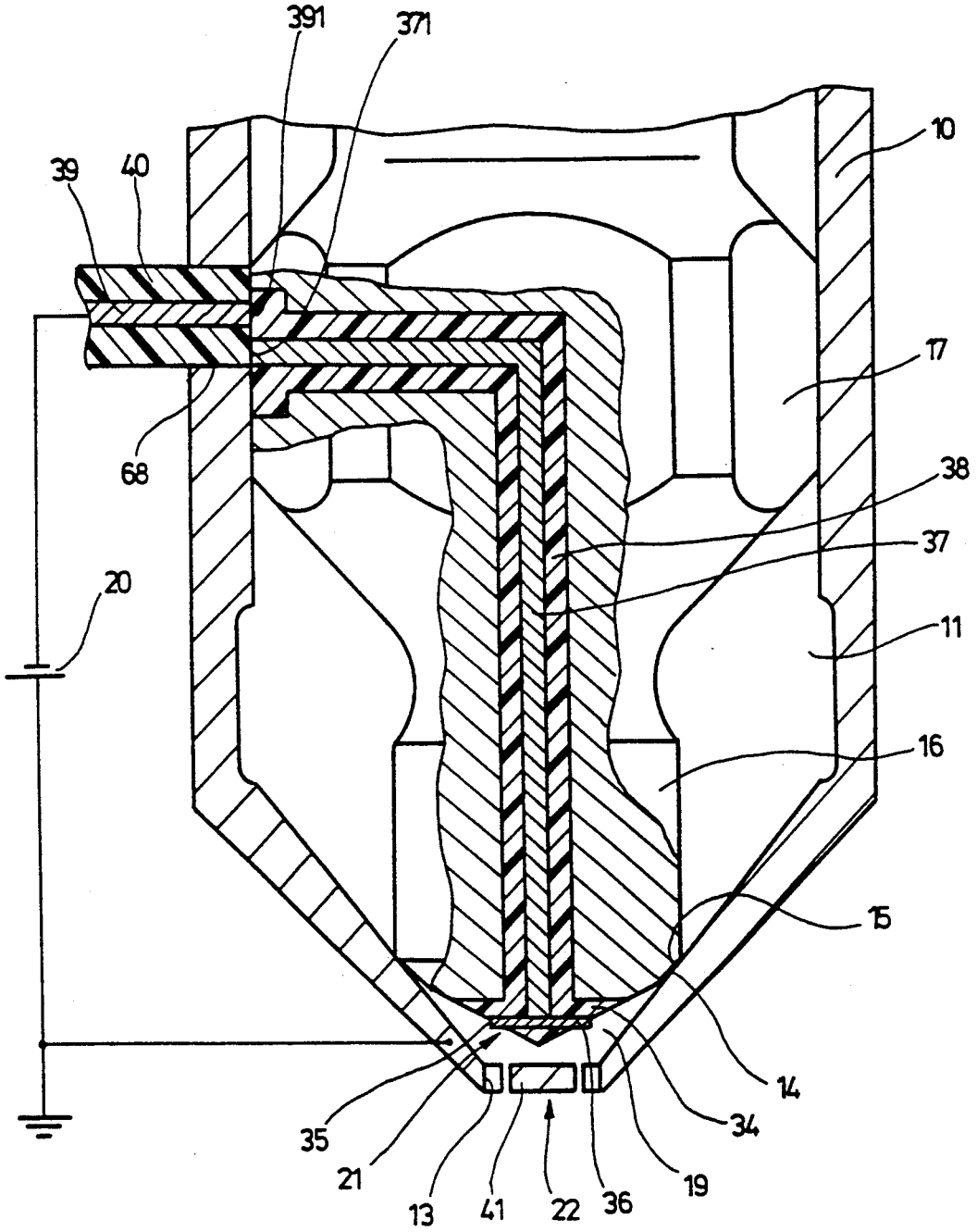

In the fuel injection valve depicted partially and in longitudinal section in FIG. 3, the valve needle 16 bears an insulating cone 34 on its front end delimiting the intermediate space 19, the emitter electrode 21 being formed as an annular face 35 on the said cone. The annular face 35 is realized by means of a solid disc 36 which is inserted into the insulating cone 34 transversely to the axis of the valve needle in such a way that its disc edge forming the annular face 35 protrudes slightly from the insulating cone 34. The solid disc 36 is connected to a first electrical supply lead 37 which is passed partially through the valve needle 16 in an insulating sleeve 38 and ends in the outer surface of the sliding portion 17 of the valve needle 16. A second electrical supply lead 39 is connected to the negative high-voltage potential of the high-voltage source 20 and passed by means of an insulating piece 40 through a radial bore 68 introduced into the nozzle body 10 in the region of the sliding portion 17 of the valve needle 16. The second supply lead 39 ends flush with the inner wall of the nozzle body 10. The mutually facing end faces 371 and 391 of the two supply leads 37, 39 are here placed in such a way that, with the closing face 15 of the valve needle 16 lifted off from the valve seat 14, they contact each other and, with the closing face 15 resting on the valve seat 14, are separated from each other. This ensures that the electrostatic field between the emitter electrode 21 and the counterelectrode 22 is only present when the injection valve is open, during the injection period. A perforated plate 41 which is inserted into the nozzle opening 13 and is connected to the earth potential of the high-voltage source 20 via the nozzle body 10 serves as counterelectrode 22.

Figure 4:
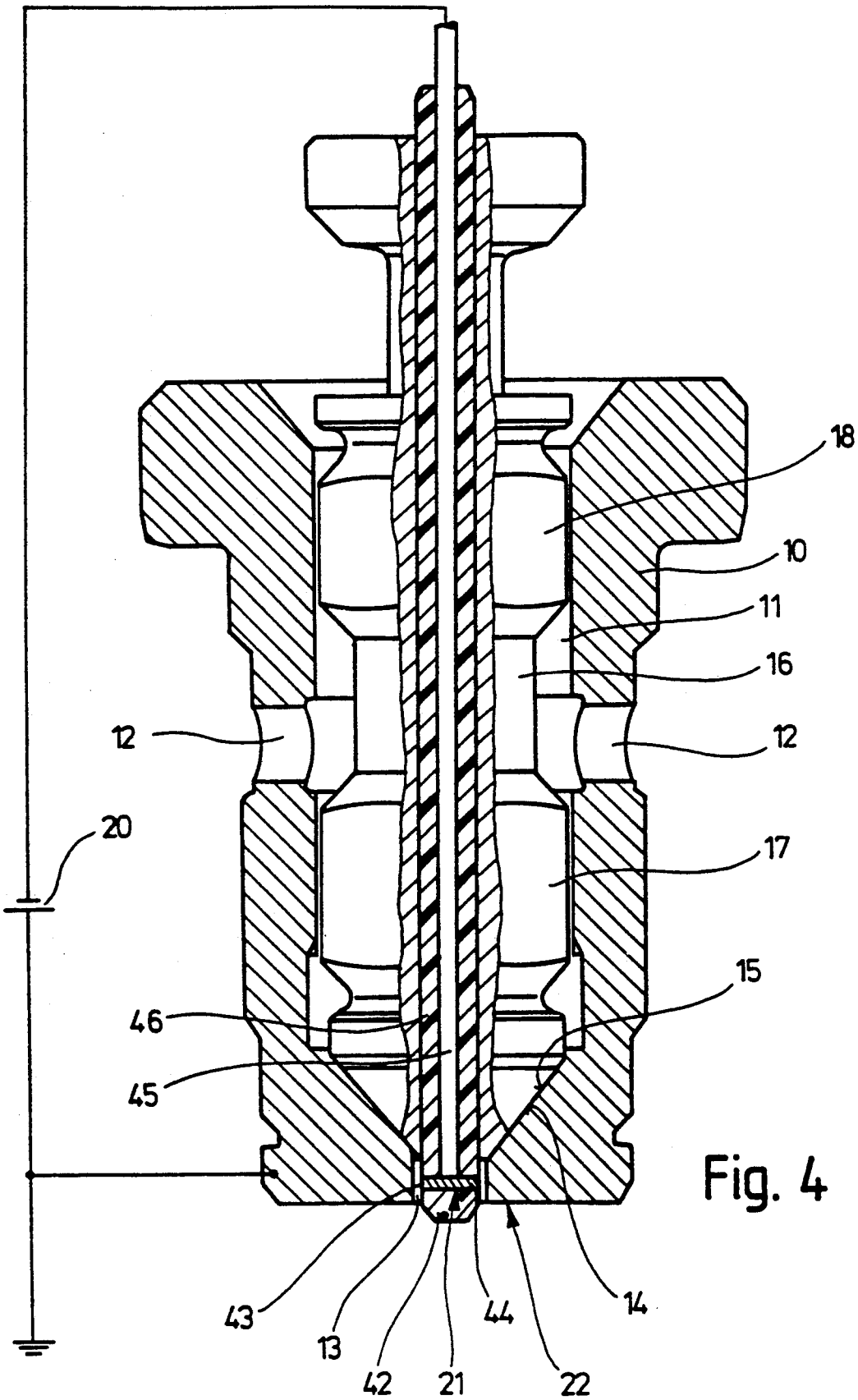

In the illustrative embodiment of a fuel injection valve depicted in FIG. 4, the valve needle 16 is of frustoconical design at the front end, the truncated cone at the front end taking up the entire interior of the nozzle body 10 as far as the nozzle opening 13. The closing face 15 of the valve needle 16 is formed by a part of the lateral surface of the truncated cone. Secured on the end face of the truncated cone is an insulating cylinder 42 which projects with clearance through the nozzle opening 13. The emitter electrode 21 is formed on the insulating cylinder 42 as an annular face 43 in the region of the nozzle opening 13, this being realized by means of a solid disc 44 which is inserted into the insulating cylinder 42 transversely to the axis of the valve needle in such a way that its disc circumference forming the annular face 43 is flush with the outer surface of the insulating cylinder 42. The disc 44 is connected via an electrical connecting lead 45 to the negative high-voltage potential of the high-voltage source 20. The connecting lead 45 is surrounded by an insulating covering 46 and passed coaxially through the valve needle 16. The nozzle body 10 forming the counterelectrode 22 is connected to the earth potential of the high-voltage source.

Figure 5:
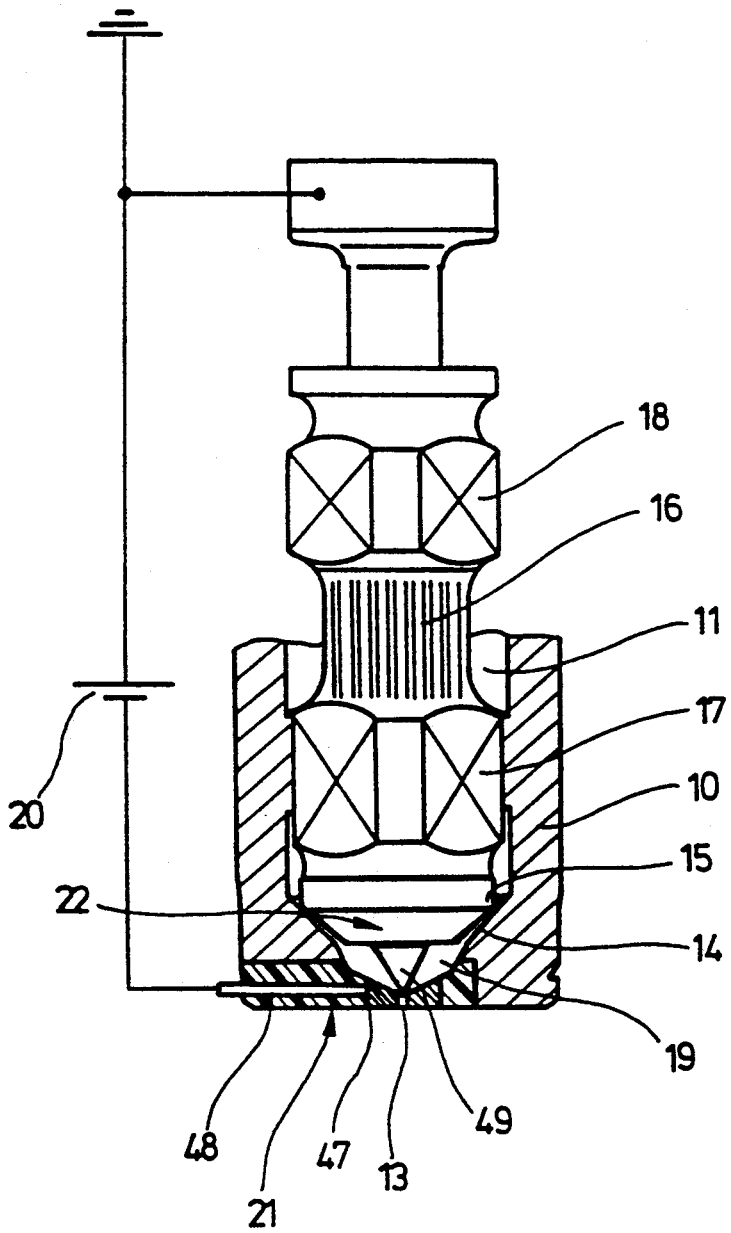

In the further illustrative embodiment of a fuel injection valve, depicted partially in FIG. 5, the emitter electrode 21 is formed on the nozzle body 10 and the counterelectrode 22 is formed on the valve needle 16. For this purpose, that region 47 of the nozzle body 10 which contains the nozzle opening 13 is produced from a material which is suitable for field emission of electrical charge carriers and is electrically insulated from the remainder of the nozzle body 10. Leading to this region 47 is a connecting lug 48 which is insulated from the nozzle body 10 and via which the emitter electrode 21 is connected to the negative high-voltage potential of the high-voltage source 20. At its front end which closes off the intermediate space 19, the valve needle 16 bears a small conical tip 49, which is arranged coaxially and reaches as far as the nozzle opening 13 when the injection valve is closed. The valve needle 16 forms the counterelectrode 22 and, for this purpose, is connected to the earth potential of the high-voltage source 20.

Figure 6:
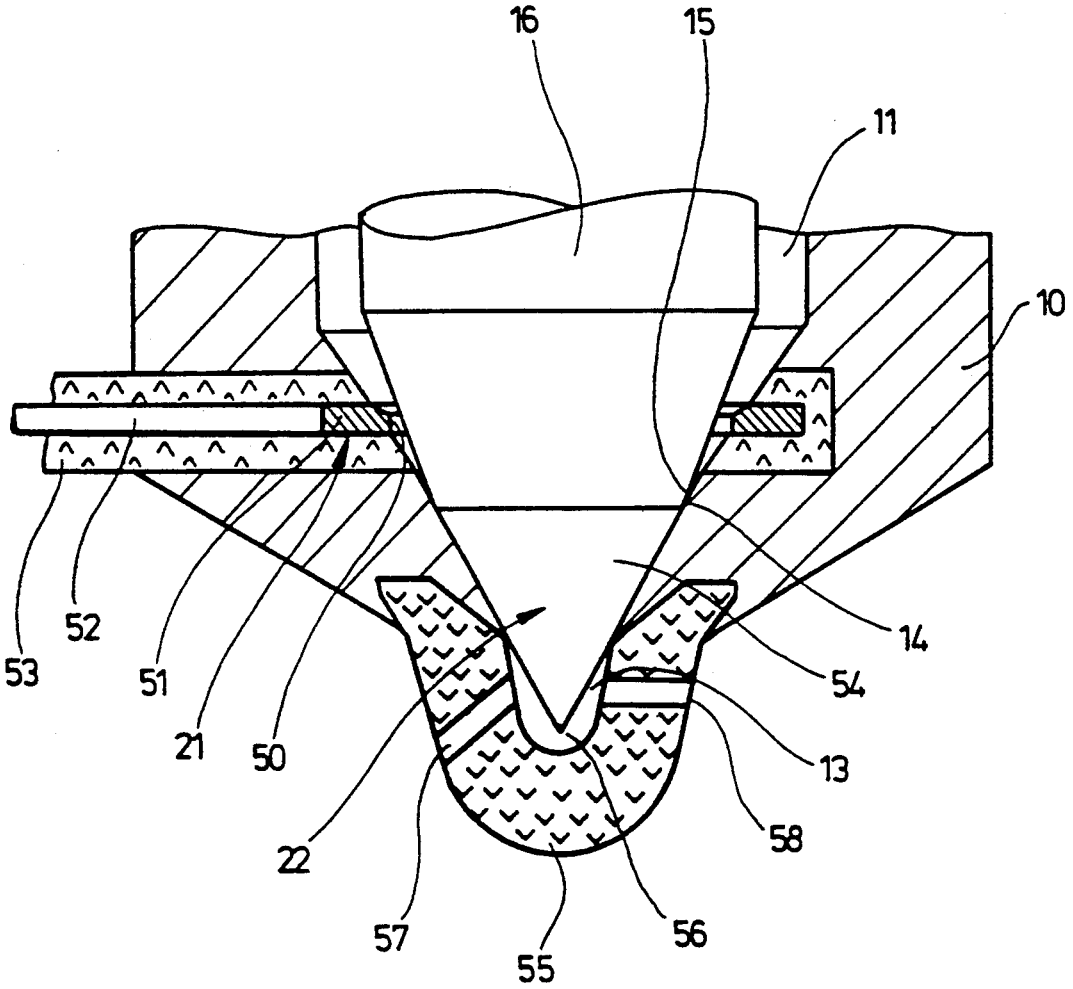
Figure 7:
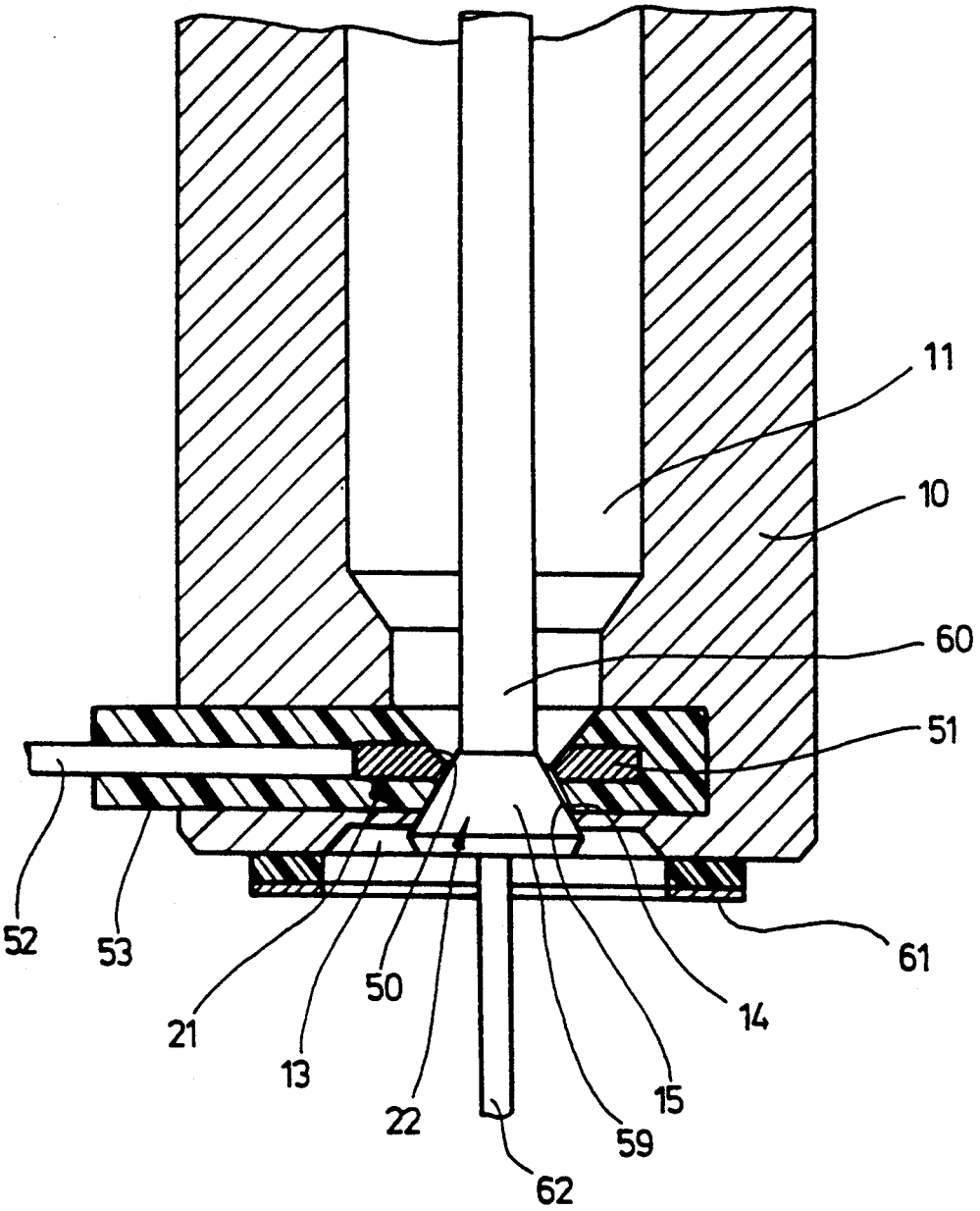

In the fuel injection valves depicted partially and in longitudinal section in FIGS. 6 and 7, the electric field is produced upstream of the valve seat 14, in the valve chamber 11. For this purpose, the emitter electrode 21 is arranged as an insulated annular face 50 in the valve chamber 11, directly upstream of the valve seat 14 as seen in the direction of fuel flow, and is connected to the negative or positive high-voltage potential of the high-voltage source. To realise this emitter electrode 21 in practice, an annular disc 51 is inserted into the nozzle body 10 transversely to the axis of the nozzle body in electrically insulated fashion, in such a way that its inner annular edge forming the annular face 50 protrudes slightly from the inner wall of the nozzle body 10 or ends flush with the latter. The inner annular edge of the annular disc 51 can be bevelled, with the result that the annular face 50 tapers to a point. The annular disc 51 is connected to an electrical conductor 52 and, via the latter, preferably connected to the negative high-voltage potential of a high-voltage source. The electrical insulation of annular disc 51 and conductor 52 is effected by an insulating layer 53, which completely surrounds the annular disc 51 and the conductor 52.

In the fuel injection valve according to FIG. 6, the valve needle 16 is shaped into a cone 54 at the front end, the said cone taking up the entire lower space of the nozzle body 10 as far as the nozzle opening 13 and projecting with its tip through the nozzle opening 13 when the valve is closed. The valve needle 16 forms the counterelectrode 22 and, for this purpose, is connected to the earth potential of the high-voltage source. The nozzle opening 13 can be closed off by a non-metallic body here a ceramic body 55 which is inserted into the nozzle body 10 at the end and bears a blind hole 55 coaxial to the nozzle opening 13. Extending outwards from the blind hole 55 are one or more fuel outlet bores 57, 58, which enclose an acute angle or, alternatively, depending on the application, a right angle, with the axis of the nozzle body.

In contrast to the fuel injection valves according to FIGS. 1–6, the fuel injection valve partially to be seen in FIG. 7 has an outward-opening valve. The valve opening, surrounded by the valve seat 14, and the nozzle opening 13 are arranged directly adjacent, the intermediate space 19 present in the valves according to FIGS. 1–6 thus disappearing, as does any clearance volume. The valve member is formed by a truncated cone 59, which is secured on an actuating rod 60 connected to the armature of the electromagnet, the said rod projecting through the valve opening. The closing face 15 is formed by a part of the lateral surface of the cone. The valve seat 14 is formed on the nozzle body 10 on that side of the valve opening which faces away from the valve chamber 11. In the example depicted, the valve seat 14 is formed on the insulating layer 53 but can also be arranged on the nozzle body 10 itself. The truncated cone 59 and the actuating rod 60 form the counterelectrode 22 to the emitter electrode 21 on the nozzle body 10 and are connected to the earth potential of the high-voltage source. An annular electrode 61 is arranged in insulated fashion and coaxially to the nozzle opening 13 on the free front end of the nozzle body 10.

On its outer truncated-cone face, the truncated cone 59 furthermore bears a coaxial pin 62. The annular electrode 61 has a potential which is between that of the emitter electrode 21 and that of the counterelectcrode 22. The pin 62 is connected in electrically conducting fashion to the truncated cone 59. By means of these electrodes formed by the annular electrode 61 and the pin 62, an electric field is produced in the outer space, by means of which field it is possible to influence and control the fuel charged with charge carriers after it leaves the nozzle opening 13. The pin 62 can also be insulated from the truncated cone 59 and provided with a suitable electric potential, this increasing the possibility of variation for the production of electric fields in the outer space.

In the fuel injection valve according to FIGS. 8 and 9 the valve needle 16 is shaped into a cone 63 at the front end, as in FIG. 6, the said cone being situated on the far side of the valve seat 14 as seen from the valve chamber 11 and projecting into the intermediate space 19, which is formed by a blind-hole bore 64 and is connected to the outside via fuel outlet bores 65 forming the nozzle opening 13. Emitter material is introduced into the cone 63 or the cone is manufactured completely from the said material and forms the emitter electrode 21. Fuel flows around the valve needle 16 in the lower region of the valve chamber 11, upstream of the valve seat 14, and the valve needle is guided in axially displaceable fashion in the upper region of the valve chamber 11 by means of a sliding portion 66. An insulating layer 67 is applied to the sliding portion 66 or to the inner wall of the valve chamber 11 in the region of the displacement travel of the sliding portion 66. The valve needle 16 is connected to a high-voltage potential, while the nozzle body 10 is connected to earth as counterelectrode 22. As long as the valve needle 16 is resting on the valve seat 14, there is an electrical contact between emitter electrode 21 and counterelectrode 22. As soon as the valve needle 16 lifts off from the valve seat 14, the contact is interrupted and a voltage is built up. This design of the fuel injection valve is simple in terms of construction and suitable particularly for valves with very thin valve needles.

In all the fuel injection valves described, a direct-voltage source is used as the high-voltage source. The use of an alternating voltage source is likewise possible, although, in this case, it is advantageous if both electrodes are produced from a material suitable for field emission of electrical charge carriers, i.e. both electrodes emit charge carriers. The amount of high voltage applied can be varied with time, it being possible for the variation to be slow or rapid in comparison with the duration of the injection cycle or to be synchronised with the injection cycle. Matching to variable electrode spacings during the opening and closing of the injection valve is thus possible, the electrical charging process of the fuel becomes controllable and a variation of the atomization during the injection process both spatially and with respect to time becomes achievable. The droplet size and the spread of the spray jet can thus be set in controlled fashion.

The parts provided for the purpose of electrical insulation, such as, for example, insulating cylinders 24 and 42, insulating layer 33 and 53, insulating covering 38 and 46, insulating cone 34 and insulating piece 40 can be composed of any materials suitable for this purpose, such as plastic (e.g. FIG. 1), rubber, glass, ceramics (e.g. FIG. 6) etc. The hatching of these electrically insulating parts is thus to be regarded only as an illustrative indication of a particular insulating material, which can, however, be replaced by any other insulating material.

The foregoing relates to a preferred exemplary embodiment of the invention, it being understood that other variants and embodiments thereof are possible within the spirit and scope of the invention, the latter being defined by the appended claims.

We claim:

1. A fuel injection valve for fuel injection systems of internal-combustion engines, with a hollow nozzle body which encloses a valve chamber and, at one end, bears a nozzle opening for the emergence of the fuel, a valve seat formed on the nozzle body and a closing seat formed on a valve needle which, together with the valve seat, closes off the valve chamber, said valve needle is displaceable axially for the purpose of lifting off from and pressing onto the valve seat, in that at least one first and one second electrode connected to a high voltage are provided, of which at least one of said at least one first and one second electrode is an emitter electrode which is composed of a material suitable for field emission of electrical charge carriers, in that at least one of said at least one first electrode is arranged on the valve needle (16) and at least one of said at least one second electrode is arranged on the nozzle body (10) in such a way that an electric field passing through the fuel flow is formed relative to the valve seat (14), and in that the at least one emitter electrode connected to a high-voltage potential is insulated from one of, the valve needle (16) and the nozzle body (10) at least for a duration of a valve opening, and at least one further electrode is arranged downstream of the nozzle opening (13), as seen in a direction of a flow of the fuel.

2. A fuel injection valve for fuel injection systems of internal-combustion engines, with a hollow nozzle body which encloses a valve chamber and, at one end, bears a nozzle opening for the emergence of the fuel, a valve seat formed on the nozzle body and a closing seat formed on a valve needle which, together with the valve seat, closes off the valve chamber, said valve needle is displaceable axially for the purpose of lifting off from and pressing onto the valve seat, in that at least one first and one second electrode connected to a high voltage are provided, of which at least one of said at least one first and one second electrode is an emitter electrode which is composed of a material suitable for field emission of electrical charge carriers, in that at least one of said at least one first electrode is arranged on the valve needle (16) and at least one of said at least one second electrode is arranged on the nozzle body (10) in such a way that an electric field passing through the fuel flow is formed relative to the valve seat (14), and in that the at least one emitter electrode connected to a high-voltage potential is insulated from one of, the valve needle (16) and the nozzle body (10) at least for a duration of a valve opening, and which is guided in an axially displaceable fashion in the valve chamber (11), in that the valve seat (14) faces the valve chamber (11) and is arranged at a distance from and upstream of the nozzle opening (13) , with a result that an intermediate space (19) is present between the said nozzle opening and the valve needle (16) resting on the valve seat (14), and in that the at least one emitter electrode (21) is situated on a front end of the valve needle (16) which delimits the intermediate space (19).

3. An injection valve according to claim 2, in that the at least one emitter electrode (21) is inserted coaxially into the valve needle (16) and protrudes form the valve needle at the front end into the intermediate space (19), with a cone.

4. An injection valve according to claim 3, in that the at least one emitter electrode (21) is insulated from the valve needle (16) and is connected by means of a connecting lead (26) passed centrally through the valve needle (16) in insulated fashion to a negative high-voltage potential, and the at least one second electrode is a counterelectrode (22) formed by the nozzle body (10) which is connected to a high voltage potential different from the negative high-voltage potential connected to said at least one emitter electrode.

5. An injection valve according to claim 2, in that the at least one emitter electrode (21) is formed by an annular cylinder (28) which is secured on the front end of the valve needle (16) and includes an annular wall which tapers towards a free end and ends in an annular ridge (281).

6. An injection valve according to claim 5, in that the at least one second electrode is a counterelectrode (22) formed by an annular face (30) surrounding the nozzle opening (13).

7. An injection valve according to claim 6, in that the annular face (30) is realized by means of an electrically conducting plate (31) which is inserted in insulated fashion in the nozzle body (10) in a region of the nozzle opening (13), transversely to the axis of the nozzle body, has a passage bore (32) congruent with the nozzle opening (13) and is connected to a positive high-voltage potential, and in that the valve needle (16) is connected to a voltage potential different from the positive high-voltage potential.

8. An injection valve according to claim 2, in that the at least one emitter electrode (21) is formed by an annular electrode face (35) on an insulating cone (34) secured on the front end of the valve needle (16), the said annular electrode face being connected to a negative high-voltage potential by means of an electrical supply lead (37, 39) passed through the valve needle (16) in insulated fashion, and in that the at least one second electrode is a counterelectrode (22) which is formed by the nozzle body (10) which is connected to a high voltage potential differing from the said negative high-voltage potential connected to said annular electrode face (35).

9. An injection valve according to claim 8, in that a perforated plate (41) is inserted in the nozzle opening (13) of the nozzle body (10).

10. An injection valve according to claim 8, in that the annular electrode face (35) is realized by means of a disc (36) which is inserted in the insulating cone (34) transversely to the axis of the a valve needle in such a way that a disc edge protrudes slightly from the insulating cone (34).

11. An injection valve according to claim 8, in that the valve needle (16) is guided on an inner wall of the nozzle body (10) by at least one sliding portion (17, 18) having a diameter similar to that of said inner wall of the nozzle body (10), in that the electrical supply lead (37, 39) to the annular electrode face (35) is divided into two supply lead portions (37, 39), of which one supply lead portion (37) is connected to the annular electrode face (35) and ends in an outer surface of the sliding portion (17) of the valve needle (16) and the other supply lead portion (39) is connected to the negative high-voltage potential and ends in the inner wall of the nozzle body (10), and in that end points (371, 391) of the two lead portions (37, 39) are placed in such a way relative to one another that, with the closing seat (15) of the valve needle (16) lifted off from the valve seat (14), the end points contact each other and, with the closing seat (15) of the valve needle (16) resting on the valve seat (14), the end points are separated from each other.

12. An injection valve according to claim 2, in that the at least one emitter electrode (21) is formed by a cone (63) arranged on the front end of the valve needle (16).

13. An injection valve according to claim 12, in that the valve needle (16) is guided with at least one sliding portion (66) on an inner wall of the nozzle body (10), in that an insulating layer (67) is arranged between the sliding portion (66) and the inner wall of the nozzle body (10) and that one of the valve needle (16) and the nozzle body (10) are connected to the high-voltage potential.

14. A fuel injection valve for fuel injection systems of internal-combustion engines, with a hollow nozzle body which encloses a valve chamber and, at one end, bears a nozzle opening for the emergence of the fuel, a valve seat formed on the nozzle body and a closing seat formed on a valve needle which, together with the valve seat, closes off the valve chamber, said valve needle is displaceable axially for the purpose of lifting off from and pressing onto the valve seat, in that at least one first and one second electrode connected to a high voltage are provided, of which at least one of said at least one first and one second electrode is an emitter electrode which is composed of a material suitable for field emission of electrical charge carriers, in that at least one of said at least one first electrode is arranged on the valve needle (16) and at least one of said at least one second electrode is arranged on the nozzle body (10) in such a way that an electric field passing through the fuel flow is formed relative to the valve seat (14), and in that the at least one emitter electrode connected to a high-voltage potential is insulated from one of, the valve needle (16) and the nozzle body (10) at least for a duration of a valve opening, and which is guided in an axially displaceable fashion in the valve chamber (11), in that a front end of the valve needle (16) is of frustoconical shape, and on an end face of a truncated cone includes an insulating cylinder (42) which projects through the nozzle opening (13), in that the at least one emitter electrode (21) is shaped as an annular face (43) on the insulating cylinder (42), in the region of the nozzle opening, and is connected via an electrical supply lead (45) which passes through the valve needle (16) in insulated fashion to a negative high-voltage potential, and in that the at least one second electrode is a counterelectrode (22) which is formed by the nozzle body (10), which is connected to a high voltage potential different from the said negative high-voltage potential connected to the annular face (43).

15. An injection valve according to claim 14, in that the annular face (43) is realized by means of a disc (44) which is inserted into the insulating cylinder (42) transversely to the axis of the valve needle in such a way that its disc circumference is flush with an outer surface of the insulating cylinder (42).

16. A fuel injection valve for fuel injection systems of internal-combustion engines, with a hollow nozzle body which encloses a valve chamber and, at one end, bears a nozzle opening for the emergence of the fuel, a valve seat formed on the nozzle body and a closing seat formed on a valve needle which, together with the valve seat, closes off the valve chamber, said valve member is displaceable axially for the purpose of lifting off from and pressing onto the valve seat, in that at least one first and one second electrode connected to a high voltage are provided, of which at least one of said at least one first and one second electrode is an emitter electrode which is composed of a material suitable for field emission of electrical charge carriers, in that at least one of said at least one first electrode is arranged on the valve needle (16) and at least one of said at least one second electrode is arranged on the nozzle body (10) in such a way that an electric field passing through the fuel flow is formed relative to the valve seat (14), and in that the at least one emitter electrode connected to a high-voltage potential is insulated from one of, the valve needle (16) and the nozzle body (10) at least for a duration of a valve opening, the at least one emitter electrode is formed by a region (47) of the nozzle body (10) which contains the nozzle opening (13).

17. An injection valve according to claim 16, in that the region (47) of the nozzle body (10) which forms the at least one emitter electrode is electrically insulated from the remainder of the nozzle body (10) and is connected to the high-voltage potential.

18. An injection valve according to claim 17, in that the valve member is a valve needle (16) which is guided in an axially displaceable fashion in the valve chamber (11) and one end includes said closing seat (15) which interacts with the valve seat (14), in that the valve seat (15) is arranged facing the valve chamber (11) and at a distance from and upstream of the nozzle opening (13), with a result that an intermediate space (19) is present between said nozzle opening and the valve needle (16) resting on the valve seat (14), and in that, on a front end, the valve needle (16) includes a conical tip (49) that projects into the intermediate space (19) and is connected to a high voltage potential different from the high-voltage potential connected to said at least one emitter electrode.

19. A fuel injection valve for fuel injection systems of internal-combustion engines, with a hollow nozzle body which encloses a valve chamber and, at one end, bears a nozzle opening for the emergence of the fuel, a valve seat formed on the nozzle body and a closing seat formed on a valve needle which, together with the valve seat, closes off the valve chamber, said valve member is displaceable axially for the purpose of lifting off from and pressing onto the valve seat, in that at least one first and one second electrode connected to a high voltage are provided, of which at least one of said at least one first and one second electrode is an emitter electrode which is composed of a material suitable for field emission of electrical charge carriers, in that at least one of said at least one first electrode is arranged on the valve needle (16) and at least one of said at least one second electrode is arranged on the nozzle body (10) in such a way that an electric field passing through the fuel flow is formed relative to the valve seat (14), and in that the at least one emitter electrode connected to a high-voltage potential is insulated from one of, the valve needle (16) and the nozzle body (10) at least for a duration of a valve opening, the at least one emitter electrode is arranged as an annular face (50) in the valve chamber (11), directly upstream of the valve seat (14).

20. An injection valve according to claim 19, in that annular face (50) is attached to the nozzle body (10) in insulated fashion and is connected to said high-voltage potential, and the valve member is connected to a voltage potential different from the high-voltage potential of the annular face (50).

21. An injection valve according to claim 20, in that the annular face (50) is realized by an annular disc (51) which is inserted in electrically insulated fashion into the nozzle body (10), transversely to the axis of the nozzle body, in such a way that its inner annular edge protrudes slightly from an inner wall of the nozzle body (10).

22. An injection valve according to claim 21, in that the inner annular edge of the annular disc (51) tapers in the radial direction to an annular tip.

23. An injection valve according to claim 20, in that the valve member is formed by a truncated cone (59), a lateral surface of said cone forms, at least in part, said closing seat (15) that interacts with the valve seat (14), and the truncated cone (59) is secured on an actuating rod (60) that projects through an opening surrounded by the valve seat (14) and the valve seat (14) is formed on the nozzle body (10) on a side of the opening which faces away from the valve chamber (11).

24. An injection valve according to claim 23, in that a face of large diameter of the truncated cone (59) includes a pin-shaped extension (62) and an annular electrode (61) is mounted in insulated fashion on the end of the nozzle body (10), coaxial with the nozzle opening (13).

25. An injection valve according to claim 24, in that the pin-shaped extension (62) is insulated from the truncated cone (59) and is connected to a voltage potential opposite to that of the annular electrode (61).

26. An injection valve according to claim 19, in that the valve member is a valve needle (16) which is guided in axially displaceable fashion in the valve chamber (11) and has a cone (54) at one end, a lateral surface of the cone forms, at least in part, the closing seat (15) that interacts with the valve seat (14) and which preferably projects through the nozzle opening (13).

27. An injection valve according to claim 26, in that the nozzle opening (13) is closed off by a body (55) made of a material having an electrical conductivity the same as that of the nozzle body (10), the said body which closes off the nozzle opening having a blind hole (56) coaxial to the nozzle opening (13) and at least one fuel outlet bore (57, 58) extending at an angle to the axis of the nozzle body and opening into the blind hole (56).

* * * * *